US009534521B1

(12) United States Patent
MacCoon

(10) Patent No.: US 9,534,521 B1
(45) Date of Patent: Jan. 3, 2017

(54) BREATHER VALVE ASSEMBLY FOR USE IN ENGINE CYLINDER HEAD

(71) Applicant: Richard P. MacCoon, Camano Island, WA (US)

(72) Inventor: Richard P. MacCoon, Camano Island, WA (US)

(73) Assignee: 4-Valves, LLC, Camano Island, WA (US)

( * ) Notice: Subject to any disclaimer, the term of this patent is extended or adjusted under 35 U.S.C. 154(b) by 0 days.

(21) Appl. No.: 15/076,033

(22) Filed: Mar. 21, 2016

Related U.S. Application Data

(60) Provisional application No. 62/278,371, filed on Jan. 13, 2016.

(51) Int. Cl.
*F01M 13/04* (2006.01)
*F01M 13/00* (2006.01)
*F02F 1/24* (2006.01)

(52) U.S. Cl.
CPC ..... *F01M 13/0416* (2013.01); *F01M 13/0011* (2013.01); *F02F 1/24* (2013.01); *F01M 2013/0427* (2013.01)

(58) Field of Classification Search
CPC ..... F01M 13/0011; F01M 2013/0005; F01M 2013/0044; F01M 2013/005; F01M 2013/0055; F01M 13/04; F01M 13/0405; F01M 13/0416; F01M 2013/0422; F01M 2013/0427
See application file for complete search history.

(56) References Cited

U.S. PATENT DOCUMENTS 4,576,001 A 3/1986 Smith
5,957,118 A 9/1999 Tateno
(Continued)

*Primary Examiner* — Jacob Amick
(74) *Attorney, Agent, or Firm* — Ruttler Mills, PLLC; James J. Rutler

(57) ABSTRACT

This invention relates generally to a breather valve assembly for use in an engine cylinder head. In one embodiment, a system includes, but is not limited to, a cylinder head including at least: a rocker arm chamber including at least a breather housing mount and an air discharge port; and a valve cover positionable over the rocker arm chamber, the valve cover including at least a vent tube recess; and a breather valve assembly including at least: a housing including at least: an open bottom configured to seat on the breather housing mount such that a bottom surface portion of the rocker arm chamber forms a base of the housing; an oil/air inlet disposed near a top of the housing offset to one side; an oil outlet disposed near a bottom of the housing; a valve positioned over the oil outlet that is operable to close during a high pressure cycle within the rocker arm chamber and open during a low pressure cycle within the rocker arm chamber; an air outlet disposed on a top of the housing; and a vent tube extending between the air outlet and the air discharge port and configured to rest within the vent tube recess, wherein the breather valve assembly is squeezed in position between the bottom surface portion of the rocker arm chamber and the vent tube recess of the valve cover, and wherein the breather valve assembly is configured to relieve pressure build-up within the cylinder head by externally venting air from an air/oil mixture separated via vortex action induced during high pressure cycles while releasing separated oil back to the cylinder head during low pressure cycles.

17 Claims, 5 Drawing Sheets

(56) References Cited

U.S. PATENT DOCUMENTS

| | | | | |
|---|---|---|---|---|
| 2003/0150438 | A1 | 8/2003 | Nakamizo | |
| 2003/0172632 | A1* | 9/2003 | Matsubara | B01D 45/16 55/417 |
| 2006/0048726 | A1 | 3/2006 | Samo | |
| 2007/0095335 | A1 | 5/2007 | Matsuda | |
| 2011/0314830 | A1 | 12/2011 | Legare | |
| 2015/0354420 | A1* | 12/2015 | Kira | F02F 7/006 123/574 |

* cited by examiner

BREATHER VALVE ASSEMBLY FOR USE IN ENGINE CYLINDER HEAD

PRIORITY CLAIM

This application claims the benefit of and/or priority to U.S. provisional patent application Ser. No. 62/278,371 filed Jan. 13, 2016. The foregoing application is incorporated by reference in its entirety as if fully set forth herein.

FIELD OF THE INVENTION

This invention relates generally to a breather valve assembly for use in an engine cylinder head.

SUMMARY

In one embodiment, a system includes, but is not limited to, a cylinder head including at least: a rocker arm chamber including at least a breather housing mount and an air discharge port; and a valve cover positionable over the rocker arm chamber, the valve cover including at least a vent tube recess; and a breather valve assembly including at least: a housing including at least: an open bottom configured to seat on the breather housing mount such that a bottom surface portion of the rocker arm chamber forms a base of the housing; an oil/air inlet disposed near a top of the housing offset to one side; an oil outlet disposed near a bottom of the housing; a valve positioned over the oil outlet that is operable to close during a high pressure cycle within the rocker arm chamber and open during a low pressure cycle within the rocker arm chamber; an air outlet disposed on a top of the housing; and a vent tube extending between the air outlet and the air discharge port and configured to rest within the vent tube recess, wherein the breather valve assembly is squeezed in position between the bottom surface portion of the rocker arm chamber and the vent tube recess of the valve cover, and wherein the breather valve assembly is configured to relieve pressure build-up within the cylinder head by externally venting air from an air/oil mixture separated via vortex action induced during high pressure cycles while releasing separated oil back to the cylinder head during low pressure cycles.

In another embodiment, a system includes, but is not limited to, a cylinder head including at least: a rocker arm chamber including at least a breather housing mount recess and an air discharge port having a conical recess with a ring seal, the breather housing mount recess being located on a high side of the rocker arm chamber when the cylinder head is used on a V engine; and a valve cover positionable over the rocker arm chamber, the valve cover including at least a vent tube recess; and a breather valve assembly including at least: a housing having a cylindrical bore, the housing including at least: an open bottom configured to seat on the breather housing mount recess such that a bottom surface portion of the rocker arm chamber forms a base of the housing; an oil outlet disposed near a bottom of the housing; a flapper valve positioned over the oil outlet that is operable to close during a high pressure cycle within the rocker arm chamber and open during a low pressure cycle within the rocker arm chamber; an air outlet centered on a top of the housing and including a conical recess with a ring seal; a vent tube in a U-shape extending between the air outlet and the air discharge port and having an elongated portion configured to rest within the vent tube recess of the valve cover, the vent tube projecting through the air outlet within the housing, the vent tube including a distension on a first end and a distention on a second end for resting in the conical recess of the air outlet and the conical recess of the air discharge port, respectively; and an oil/air inlet disposed near a top of the housing above a bottom level of the vent tube and offset to one side; wherein the housing and the vent tube are secured in position within the rocker arm chamber of the cylinder head without fasteners by being squeezed between the bottom surface portion of the rocker arm chamber and the vent tube recess of the valve cover, and wherein the breather valve assembly is configured to relieve pressure build-up within the cylinder head by externally venting air from an air/oil mixture separated via vortex action induced during high pressure cycles while releasing separated oil back to the cylinder head during low pressure cycles.

In a further embodiment, a breather valve assembly includes, but is not limited to, a housing including at least: an open bottom configured to seat on a surface portion of a rocker arm chamber of a cylinder head such that the surface portion of the rocker arm chamber forms a base of the housing; an oil/air inlet disposed near a top of the housing offset to one side; an oil outlet disposed near a bottom of the housing; a valve positioned over the oil outlet that is operable to close during a high pressure cycle within the rocker arm chamber and open during a low pressure cycle within the rocker arm chamber; an air outlet disposed on a top of the housing; and a vent tube extending between the air outlet and an air discharge port of the rocker arm chamber and configured to rest within a vent tube recess of a valve cover of the cylinder head, wherein the breather valve assembly is operable to being squeezed in position between the surface portion of the rocker arm chamber and the vent tube recess of the valve cover, and wherein the breather valve assembly is configured to relieve pressure build-up within the cylinder head by externally venting air from an air/oil mixture separated via vortex action induced during high pressure cycles while releasing separated oil back to the cylinder head during low pressure cycles.

BRIEF DESCRIPTION OF THE DRAWINGS

Embodiments of the present invention are described in detail below with reference to the following drawings.

DETAILED DESCRIPTION

This invention relates generally to a breather valve assembly for use in an engine cylinder head. Specific details of certain embodiments of the invention are set forth in the following description and in FIGS. 1-7 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
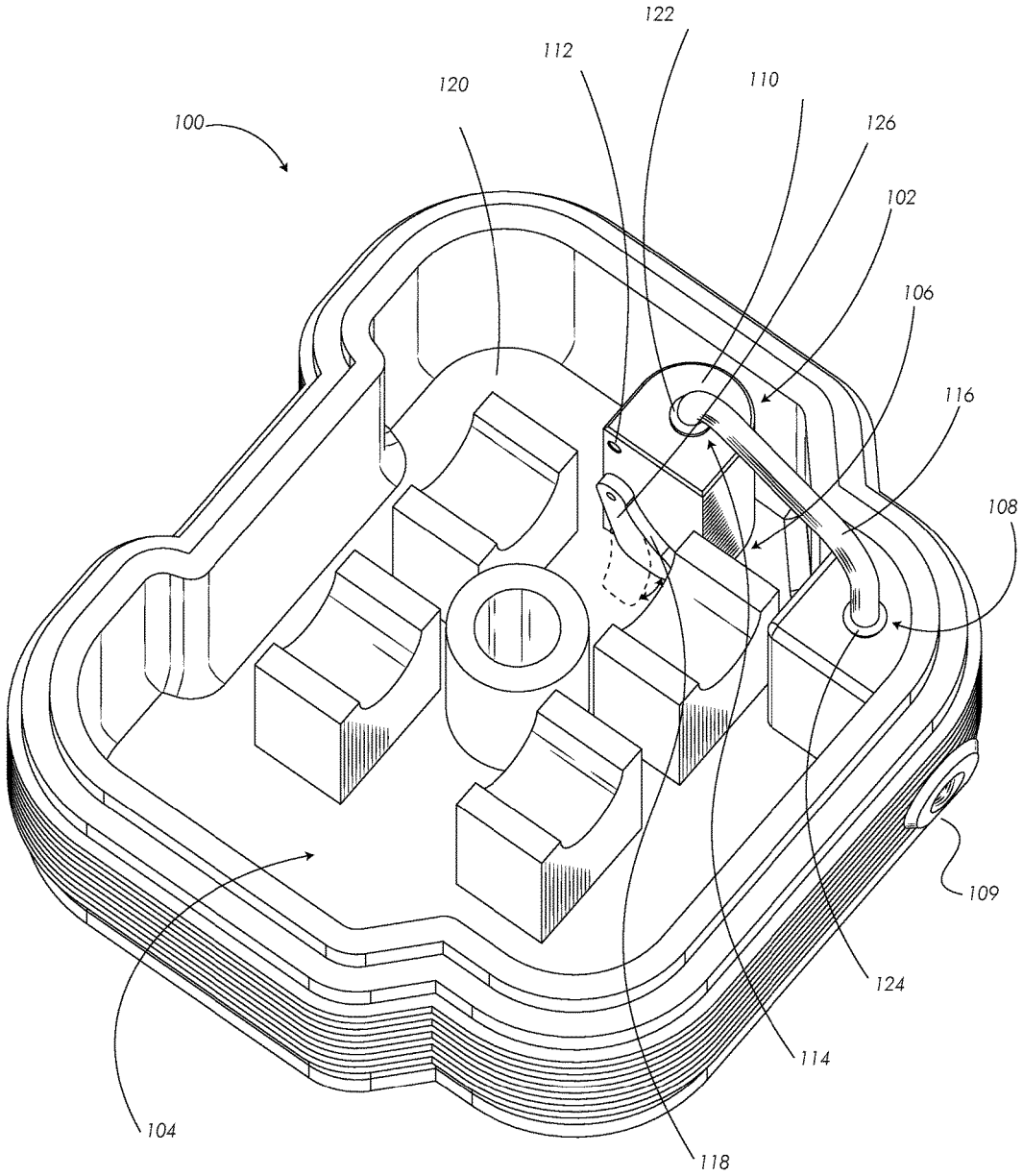
FIG. 1 is a perspective view of an engine cylinder head with a breather valve assembly, in accordance with an embodiment of the invention.
Figure 2:
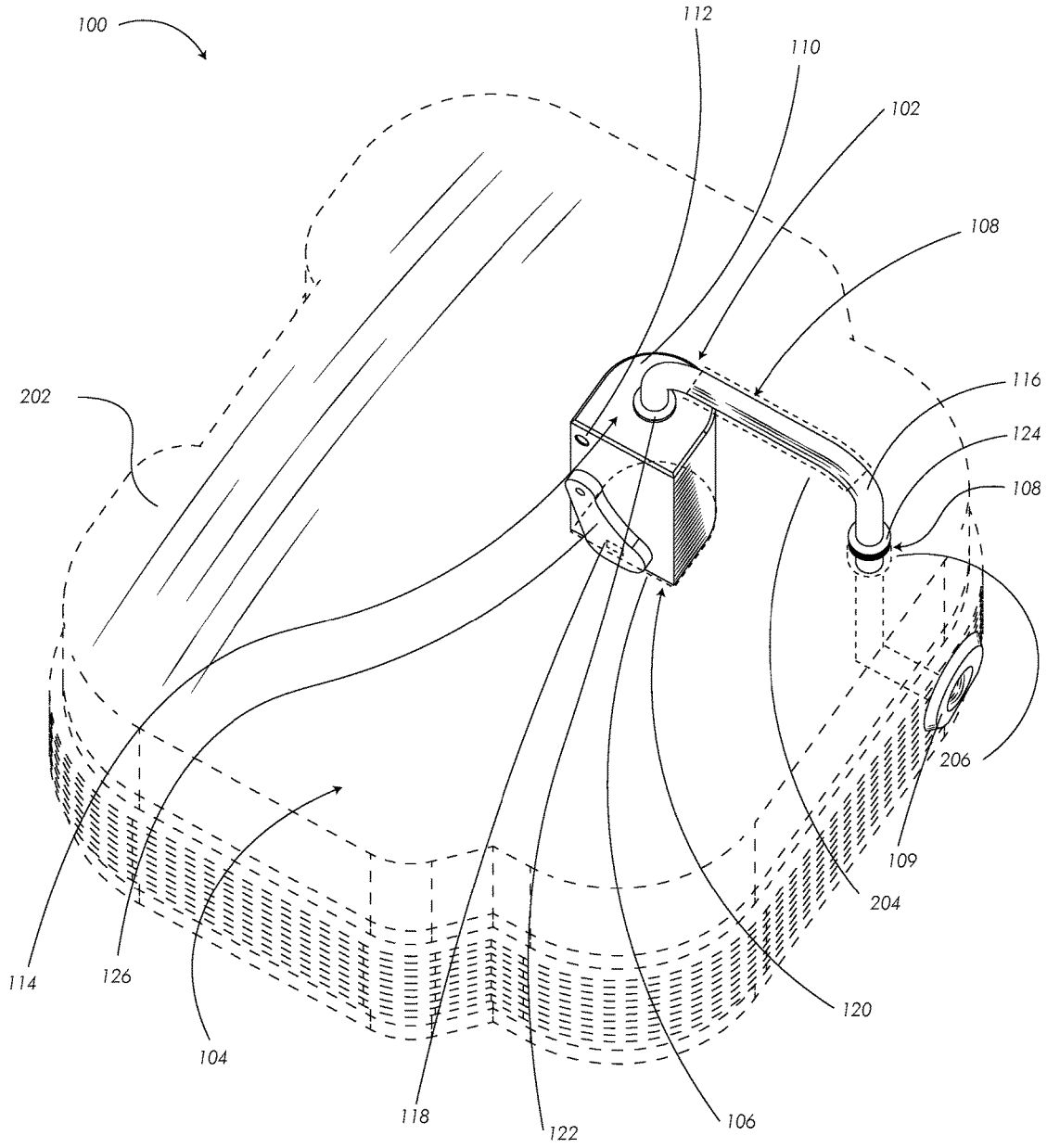
FIG. 2 is a perspective exposed view of a breather valve assembly positioned within an engine cylinder head, in accordance with an embodiment of the invention.

FIG. 1 is a perspective view of an engine cylinder head 100 with a breather valve assembly 102, in accordance with an embodiment of the invention. In one embodiment, the cylinder head 100 includes at least a rocker arm chamber 104 including at least a breather housing mount 106 and an air discharge port 108; and a valve cover (FIG. 2) positionable over the rocker arm chamber 104, the valve cover including at least a vent tube recess (FIG. 2). The cylinder head 100 includes therein the breather valve assembly 102 which includes at least: a housing 110 having at least: an open bottom (FIG. 6) configured to seat on the breather housing mount 106 such that a bottom surface portion 120 of the rocker arm chamber 104 forms a base of the housing 110; an oil/air inlet 112 disposed near a top of the housing 110 offset to one side; an oil outlet 118 disposed near a bottom of the housing; a valve positioned over the oil outlet 118 that is operable to close during a high pressure cycle within the rocker arm chamber 104 and open during a low pressure cycle within the rocker arm chamber 104; an air outlet 114 disposed on a top of the housing 110; and a vent tube 116 extending between the air outlet 114 and the air discharge port 108 and configured to rest within the vent tube recess (FIG. 2), wherein the breather valve assembly 102 is squeezed in position between the bottom surface portion 120 of the rocker arm chamber 104 and the vent tube recess of the valve cover (FIG. 2), and wherein the breather valve assembly 102 is configured to relieve pressure build-up within the cylinder head 100 by externally venting air via an air discharge vent 109 from an air/oil mixture separated via vortex action induced during high pressure cycles while releasing separated oil back to the cylinder head via the oil outlet 118 during low pressure cycles.

In operation, the breather valve assembly 102 is positioned within the rocker arm chamber 104 of the cylinder head 100. During operation of an engine, of which the cylinder head 100 is part of, the rocker arm chamber 104 experiences fluctuations in pressure between a high pressure state and a low pressure state. The fluctuations in pressure are a result of the normal piston cycles (e.g., intake, compression, power, and exhaust). During the high pressure state, a mixture of oil and air is forced through the oil/air inlet 112. Because the oil/air inlet 112 is offset to one side, a vortex is formed within the breather valve assembly 102 from the incoming mixture of oil and air. The high pressure state also operates to close the flap 126 and cover the oil outlet port 118. Because the oil is heavier than the air, the vortex action forces the oil against the walls of the cylindrical bore 304 (FIG. 3) while the air remains centrally and escapes the breather valve assembly 102 via the vent tube 116 and the vent 109. The separated oil remains within the breather valve assembly 102 and, during the low pressure state within the rocker arm chamber 104, the flap 126 is pulled opened to release the oil back into the rocker arm chamber 104. Therefore, the breather valve assembly 102 enables a release of pressure during high pressure states within the rocker arm chamber 104 by separating and venting air while retaining oil. The breather valve assembly 102 does not require batteries or an external source of power as it is powered through the differential pressure states present within the rocker arm chamber 104. The breather valve assembly 102 can repeat these operations many thousands of times per minute, dependent on the rate of engine operation.

Figure 4:
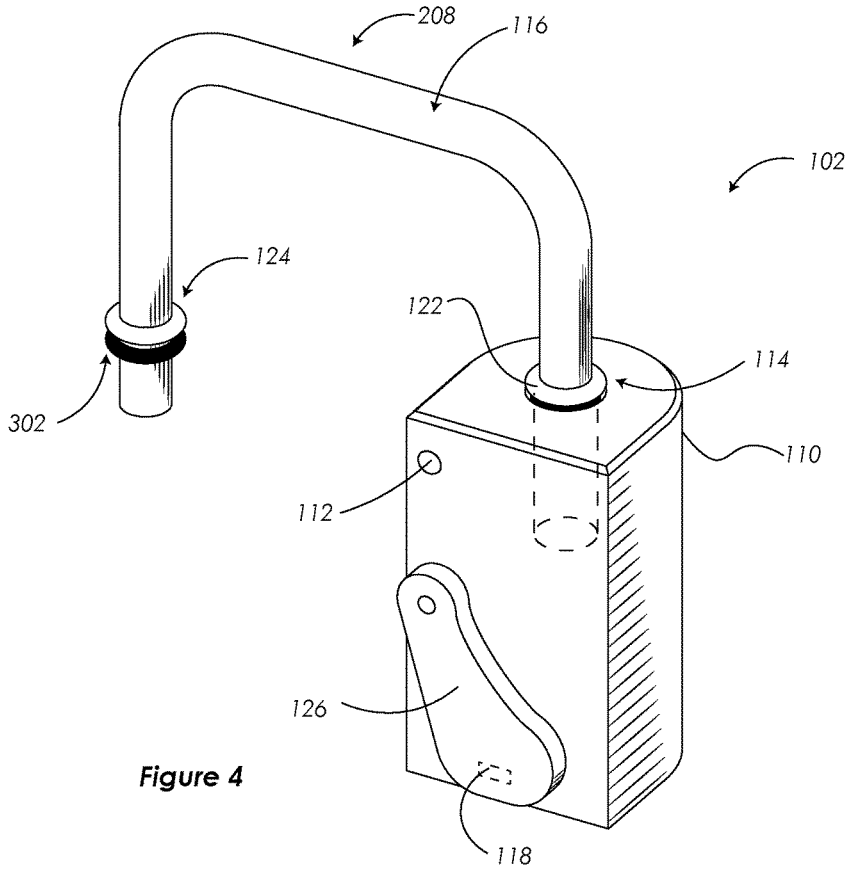
FIG. 4 is a top front-side perspective view of a breather valve assembly, in accordance with an embodiment of the invention.
Figure 5:
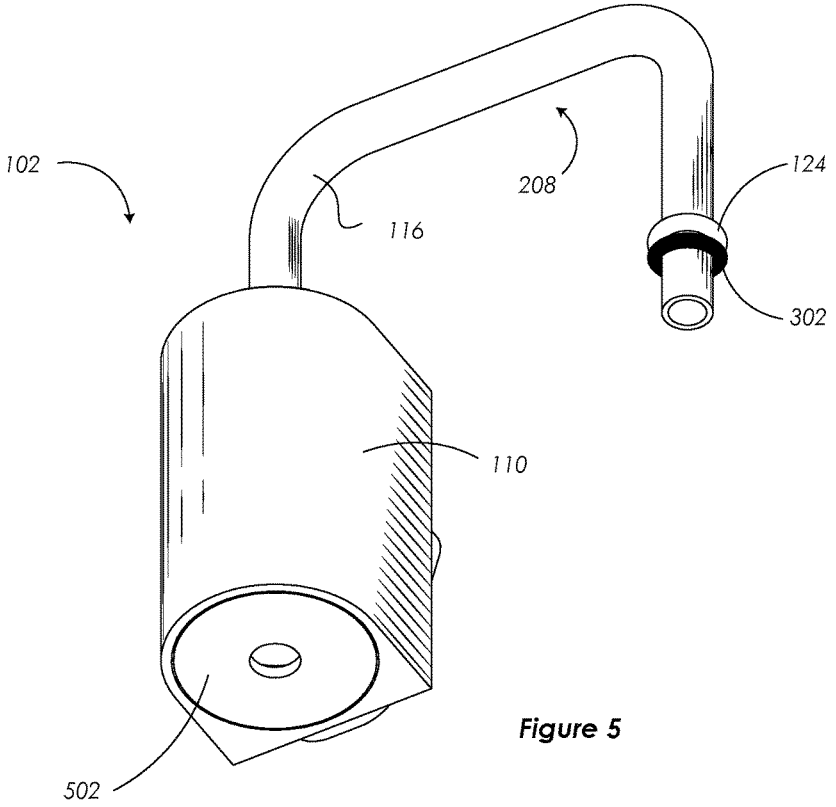
FIG. 5 is a bottom back-side perspective view of a breather valve assembly, in accordance with an embodiment of the invention.

In certain embodiments, discharged oil from the breather valve assembly 102 is released directly back into the rocker arm chamber 104. In alternative embodiments, the engine cylinder head 100 further includes an oil capture chamber operably coupled to the breather valve assembly 102 to receive discharged oil from the oil outlet 118; and a pump to forcibly return oil from the oil capture chamber to an engine oil reservoir. In some embodiments, the breather housing mount 106 is a recess in a bottom surface portion 120 of the rocker arm chamber 104, wherein the housing 110 of the breather valve assembly 102 seats in the recess. Alternatively, in certain embodiments, the breather housing mount 106 includes a spacer plate (FIG. 5) that is mounted to a bottom surface portion 120 of the rocker arm chamber 104, wherein the housing 110 of the breather valve assembly 102 seats on the spacer plate (FIG. 5). In some embodiments, the breather housing mount 106 is located on a high side of the rocker arm chamber 104 when the cylinder head 100 is used on a V engine to permit discharged oil from the oil outlet 118 to drain away from the breather valve assembly 102. In certain embodiments, the air outlet 114 is centered on the top of the housing 110 to enable vortex separated air to escape via the vent tube 116 while retaining heavier oil against internal walls of the breather valve assembly 102 for discharge via the oil outlet 118. In one embodiment, the vent tube 116 projects through the air outlet 114 within the housing 110, wherein the oil/air inlet 112 is disposed near the top of the housing 110 above a bottom level of the vent tube 116 within the housing 110 (FIG. 4). In another embodiment, the vent tube 116 includes a distention 122 on a first end and wherein the air outlet 114 includes a conical recess with a ring seal (FIG. 7) for accepting the distention 122 on the first end of the vent tube 116. In a further embodiment, the vent tube 116 includes a distention 124 on a second end and wherein the air discharge port 108 includes a conical recess with a ring seal (FIGS. 2 AND 7) for accepting the distention 124 on the second end of the vent tube 116. In other embodiments, the vent tube 116 is in a form of a U shape having an elongated portion that rests within an elongated channel of the vent tube recess of the valve cover (FIG. 2). In further embodiments, the breather valve assembly 102 includes a movable flap 126 that opens during a low pressure cycle to release oil from the oil outlet 118 and that closes during a low pressure cycle over the oil outlet 118.

In one embodiment, a system includes, but is not limited to, a cylinder head 100 including at least: a rocker arm chamber 104 including at least a breather housing mount recess 106 and an air discharge port 108 having a conical recess with a ring seal (FIGS. 2 AND 7), the breather housing mount recess 106 being located on a high side of the rocker arm chamber 104 when the cylinder head 100 is used on a V engine; and a valve cover (FIG. 2) positionable over the rocker arm chamber 104, the valve cover including at least a vent tube recess (FIG. 2); and a breather valve assembly 102 including at least: a housing 110 having a cylindrical bore (FIG. 3), the housing including at least: an open bottom (FIG. 6) configured to seat on the breather housing mount recess 106 such that a bottom surface portion 120 of the rocker arm chamber 104 forms a base of the housing 110; an oil outlet 118 disposed near a bottom of the housing 110; a flapper valve 126 positioned over the oil outlet 118 that is operable to close during a high pressure cycle within the rocker arm chamber 104 and open during a low pressure cycle within the rocker arm chamber 104; an air outlet 114 centered on a top of the housing 110 and including a conical recess with a ring seal (FIG. 7); a vent tube 116 in a U-shape extending between the air outlet 114 and the air discharge port 108 and having an elongated portion configured to rest within the vent tube recess of the valve cover (FIG. 2), the vent tube 116 projecting through the air outlet 114 within the housing 110, the vent tube 116 including a distension 122 on a first end and a distention 124 on a second end for resting in the conical recess of the air outlet (FIG. 7) and the conical recess of the air discharge port (FIGS. 2 AND 7), respectively; and an oil/air inlet 112 disposed near a top of the housing 110 above a bottom level of the vent tube 116 (FIG. 4) and offset to one side; wherein the housing 110 and the vent tube 116 are secured in position within the rocker arm chamber 104 of the cylinder head 100 without fasteners by being squeezed between the bottom surface portion 120 of the rocker arm chamber 104 and the vent tube recess of the valve cover (FIG. 2), and wherein the breather valve assembly 102 is configured to relieve pressure build-up within the cylinder head 100 by externally venting air from an air/oil mixture separated via vortex action induced during high pressure cycles while releasing separated oil back to the cylinder head 100 during low pressure cycles.

In another embodiment, a breather valve assembly 102 includes, but is not limited to, a housing 110 including at least: an open bottom (FIG. 6) configured to seat on a surface portion 120 of a rocker arm chamber 104 of a cylinder head 100 such that the surface portion 120 of the rocker arm chamber 104 forms a base of the housing 110; an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber 104 and open during a low pressure cycle within the rocker arm chamber 104; an air outlet 114 disposed on a top of the housing 110; and a vent tube 116 extending between the air outlet 114 and an air discharge port 108 of the rocker arm chamber 104 and configured to rest within a vent tube recess of a valve cover of the cylinder head (FIG. 2), wherein the breather valve assembly 102 is operable to being squeezed in position between the surface portion 120 of the rocker arm chamber 104 and the vent tube recess of the valve cover (FIG. 2), and wherein the breather valve assembly 102 is configured to relieve pressure build-up within the cylinder head 100 by externally venting air from an air/oil mixture separated via vortex action induced during high pressure cycles while releasing separated oil back to the cylinder head 100 during low pressure cycles.

In certain embodiments, the breather valve assembly 102 can be used in two or four cycle engines. The breather valve assembly 102 can be present in each cylinder of an engine (e.g., 1, 2, 3, 4, 5, 6, 7, 8, etc), or can be present only in certain cylinders (e.g., cylinders 2 and 4 of a six cylinder engine). The breather valve assembly 102 can also be present in more than one instance within a given rocker arm chamber 104 (e.g., 2, 3, or 4 breather valve assemblies 102 per rocker arm chamber 104). In some embodiments, the breather valve assembly 102 is differently shaped. For instances, the housing 110 can be cylindrical, cubical, or another regular or irregular shape. In other embodiments, the breather valve assembly 102 can be wider, narrower, taller, or shorter than depicted (e.g, 1-50% wider, narrower, taller, or shorter). In some embodiments, the breather valve assembly 102 is differently positioned within the rocker arm chamber (e.g., upside down, rotated, sideways or on a bottom, top, left, or right location relative to where depicted). In certain embodiments, the vent tube 116 is differently configured (e.g., vented through a valve cover or a different side of the cylinder head 100). In other embodiments, the breather valve assembly 102 is molded in whole or part with the cylinder head 100 or the valve cover (FIG. 2).

FIG. 2 is a perspective exposed view of a breather valve assembly 102 positioned within an engine cylinder head 100, in accordance with an embodiment of the invention. In one embodiment, a system includes, but is not limited to, a cylinder head 100 including at least: a rocker arm chamber 104 including at least a breather housing mount 106 and an air discharge port 108; and a valve cover 202 positionable over the rocker arm chamber 104, the valve cover 202 including at least a vent tube recess 204; and a breather valve assembly 102 including at least: a housing 110 including at least: an open bottom (FIG. 6) configured to seat on the breather housing mount 106 such that a bottom surface portion 120 of the rocker arm chamber 104 forms a base of the housing 110; an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber 104 and open during a low pressure cycle within the rocker arm chamber 104; an air outlet 114 disposed on a top of the housing 110; and a vent tube 116 extending between the air outlet 114 and the air discharge port 108 and configured to rest within the vent tube recess 204, wherein the breather valve assembly 102 is squeezed in position between the bottom surface portion 120 of the rocker arm chamber 104 and the vent tube recess 204 of the valve cover 202, and wherein the breather valve assembly 102 is configured to relieve pressure build-up within the cylinder head 100 by externally venting air via an air discharge vent 109 from an air/oil mixture separated via vortex action induced during high pressure cycles while releasing separated oil back to the cylinder head 100 via the oil outlet 118 during low pressure cycles.

Figure 3:
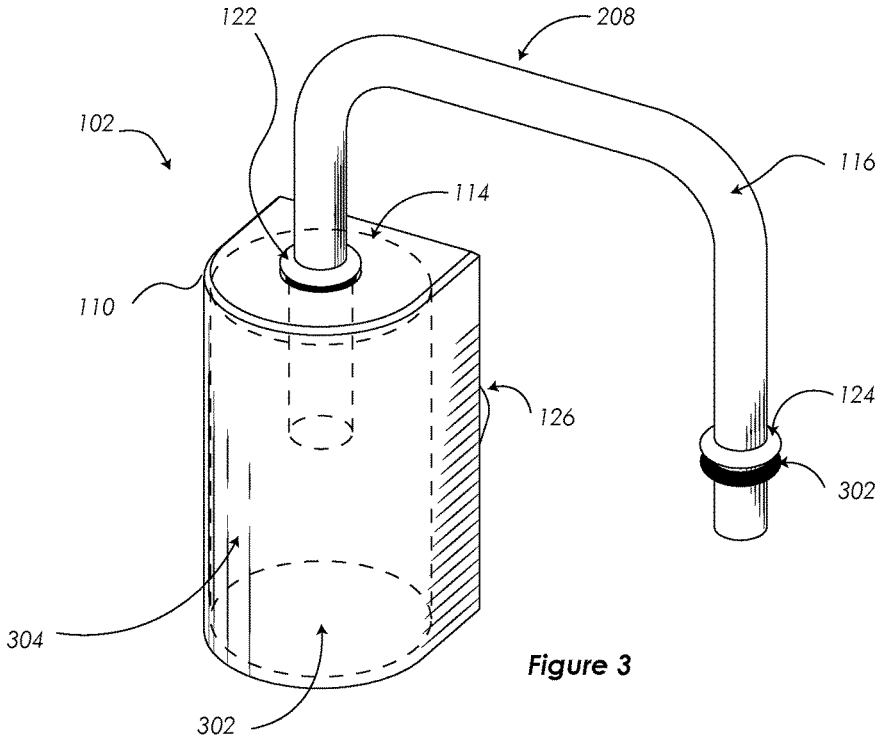
FIG. 3 is a top back-side perspective view of a breather valve assembly, in accordance with an embodiment of the invention.
Figure 7:
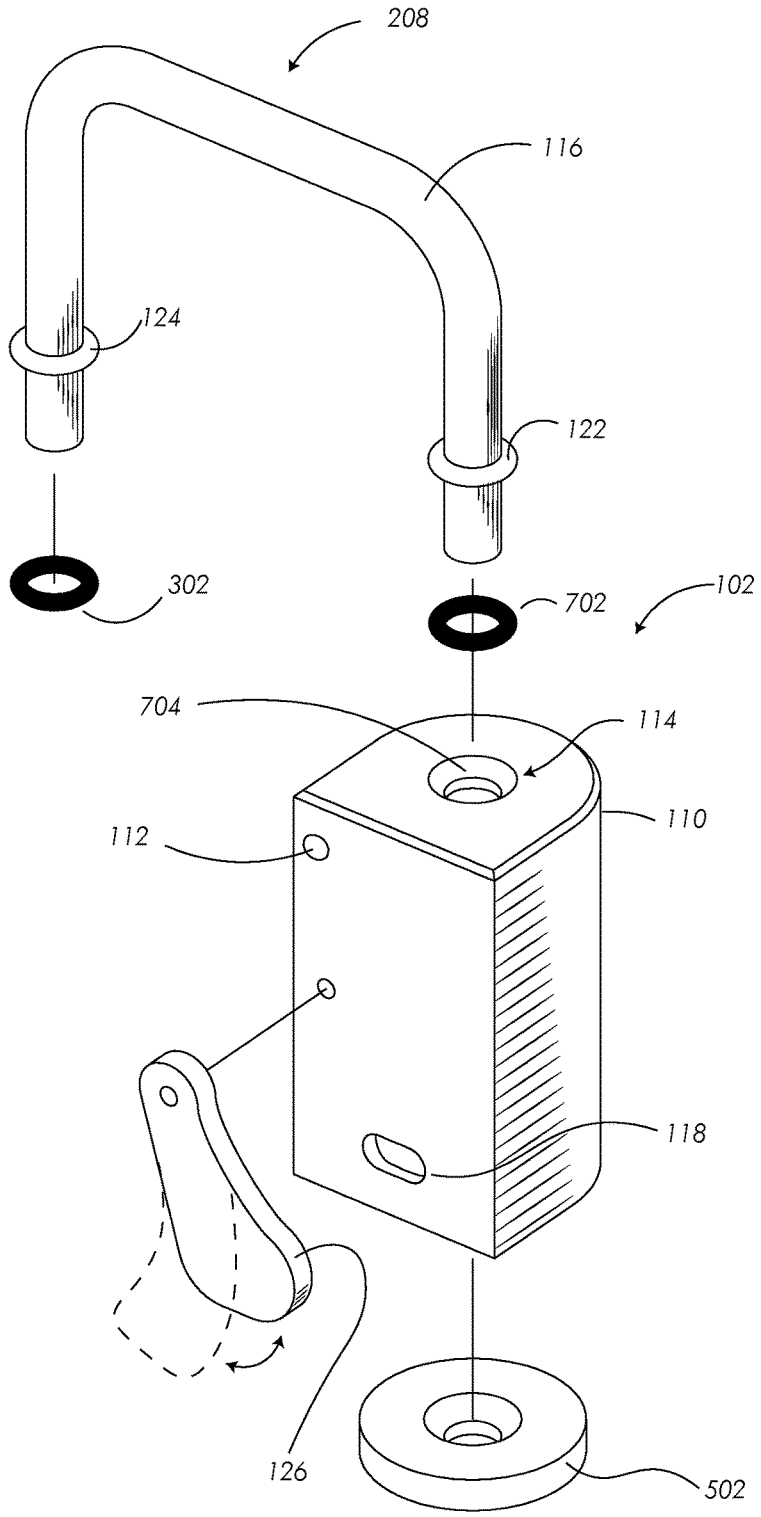
FIG. 7 is an exploded front-side perspective view of a breather valve assembly, in accordance with an embodiment of the invention.

In certain embodiments, the housing 110 includes a cylindrical bore (FIG. 3). In other embodiments, the breather housing mount 106 is a recess within a surface 120 of the rocker arm chamber 104. In other embodiments, the breather housing mount 106 is composed of a spacer plate (FIG. 5) mounted to the bottom surface portion 120 of the rocker arm chamber 104, wherein the housing 110 seats on the spacer plate (FIG. 5). In some embodiments, the air outlet 114 is centered on the top of the housing 110. In other embodiments, the vent tube 116 projects through the air outlet 114 within the housing 110 and wherein the oil/air inlet 112 is disposed near the top of the housing 110 above a bottom level of the vent tube 116 within the housing 110 (FIG. 4). In certain embodiments, the vent tube 116 includes a distention 122 on a first end and wherein the air outlet 118 includes a conical recess with a ring seal (FIG. 7) for accepting the distention 122 on the first end of the vent tube 116. In one particular embodiment, the vent tube 116 includes a distention 124 on a second end and wherein the air discharge port 108 includes a conical recess 206 with a ring seal (FIG. 7) for accepting the distention 124 on the second end of the vent tube 116. In other embodiments, the vent tube 116 is in a form of a U shape having an elongated portion 208 that rests within an elongated channel of the vent tube recess 204 of the valve cover 202. In one embodiment, the housing 110 and the vent tube 116 are secured in position within the rocker arm chamber 104 of the cylinder head 100 without fasteners by being squeezed between the bottom surface portion 120 of the rocker arm chamber 104 and the vent tube recess 204 of the valve cover 202. In one particular embodiment, the breather valve assembly 102 includes a movable flap 126 that covers the oil outlet 118 during high pressure cycles within the rocker arm chamber 104 and that opens and exposes the oil outlet 118 during low pressure cycles with in the rocker arm chamber 104. In certain embodiments, the air discharge port 108 of the rocker arm chamber 104 includes a conical recess 206 with a ring seal (FIG. 7). In other embodiments, the air outlet 114 of the housing 110 includes a conical recess with a ring seal (FIG. 7).

In one embodiment, a system includes, but is not limited to, a cylinder head 100 including at least: a rocker arm chamber 104 including at least a breather housing mount recess 106 and an air discharge port 108 having a conical recess 206 with a ring seal (FIG. 7), the breather housing mount recess 106 being located on a high side of the rocker arm chamber 104 when the cylinder head is used on a V engine; and a valve cover 202 positionable over the rocker arm chamber 104, the valve cover 202 including at least a vent tube recess 204; and a breather valve assembly 102 including at least: a housing 110 having a cylindrical bore (FIG. 3), the housing 110 including at least: an open bottom (FIG. 6) configured to seat in the breather housing mount recess 106 such that a bottom surface portion 120 of the rocker arm chamber 104 forms a base of the housing 110; an oil outlet 118 disposed near a bottom of the housing 110; a flapper valve 126 positioned over the oil outlet 118 that is operable to close during a high pressure cycle within the rocker arm chamber 104 and open during a low pressure cycle within the rocker arm chamber 104; an air outlet 114 centered on a top of the housing 110 and including a conical recess with a ring seal (FIG. 7); a vent tube 116 in a U-shape extending between the air outlet 114 and the air discharge port 108 and having an elongated portion 208 configured to rest within the vent tube recess 204 of the valve cover 202, the vent tube 116 projecting through the air outlet 114 within the housing 110, the vent tube 116 including a distension 122 on a first end and a distention 124 on a second end for resting in the conical recess of the air outlet (FIG. 7) and the conical recess 206 of the air discharge port 108, respectively; and an oil/air inlet 112 disposed near a top of the housing 110 above a bottom level of the vent tube 116 (FIG. 4) and offset to one side; wherein the housing 110 and the vent tube 116 are secured in position within the rocker arm chamber 104 of the cylinder head 100 without fasteners by being squeezed between the bottom surface portion 120 of the rocker arm chamber 104 and the vent tube recess 204 of the valve cover 202, and wherein the breather valve assembly 102 is configured to relieve pressure build-up within the cylinder head 100 by externally venting air from an air/oil mixture separated via vortex action induced during high pressure cycles while releasing separated oil back to the cylinder head 100 during low pressure cycles.

In another embodiment, a breather valve assembly includes, but is not limited to, a housing 110 including at least: an open bottom (FIG. 6) configured to seat on a surface portion 120 of a rocker arm chamber 104 of a cylinder head 100 such that the surface portion 120 of the rocker arm chamber 104 forms a base of the housing 110; an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber 104 and open during a low pressure cycle within the rocker arm chamber 104; an air outlet 114 disposed on a top of the housing 110; and a vent tube 116 extending between the air outlet 114 and an air discharge port 108 of the rocker arm chamber 104 and configured to rest within a vent tube recess 204 of a valve cover 202 of the cylinder head 100, wherein the breather valve assembly 102 is operable to being squeezed in position between the surface portion 120 of the rocker arm chamber 104 and the vent tube recess 204 of the valve cover 202, and wherein the breather valve assembly 102 is configured to relieve pressure build-up within the cylinder head 100 by externally venting air from an air/oil mixture separated via vortex action induced during high pressure cycles while releasing separated oil back to the cylinder head 100 during low pressure cycles.

In certain embodiments, the breather valve assembly 102 is recessed slightly (e.g., 1-5 mm) within a surface 120 of the rocker arm chamber 104. In other embodiments, a spacer plate 502 (FIG. 5) is countersunk and secured via a fastener (e.g., machine screw) to a surface 120 of the rocker arm chamber 104. The breather valve assembly 102 includes an open bottom 301 (FIG. 3) that seats on the spacer plate 502. In these embodiments, the breather valve assembly 102 rests in position without additional fasteners. However, the breather valve assembly 102 can be secured with fasteners, welding, or even be molded with the cylinder head 100 or valve cover 202. In some embodiments, the valve cover 202 includes a vent line and/or vent port within it and the vent tube 116 merely connects to vent line and/or vent port of the valve cover. In other embodiments, the vent tube 116 is part of the valve cover 202 (e.g., molded with the valve cover 202 or secured or fastened to the valve cover 202). In some embodiments, the vent tube 116 is ported via a surface 120 of the rocker arm chamber 104 or via the valve cover 202 or via a different side or bottom of the cylinder head 100. In some embodiments, the valve cover 202 includes a retaining mechanism that secures the vent tube 116 therein (e.g., an attachment or extension retaining mechanism rather than a channel component of the valve cover 202).

FIG. 3 is a top back-side perspective view of a breather valve assembly, in accordance with an embodiment of the invention. In one embodiment, a system includes, but is not limited to, a cylinder head including at least: a rocker arm chamber including at least a breather housing mount and an air discharge port; and a valve cover positionable over the rocker arm chamber, the valve cover including at least a vent tube recess (FIGS. 1 AND 2); and a breather valve assembly 102 including at least: a housing 110 including at least: an open bottom 301 configured to seat on the breather housing mount such that a bottom surface portion of the rocker arm chamber forms a base of the housing 110 (FIGS. 1 AND 2); an oil/air inlet (FIG. 4) disposed near a top of the housing 110 offset to one side; an oil outlet (FIG. 4) disposed near a bottom of the housing 110; a valve 126 positioned over the oil outlet (FIG. 4) that is operable to close during a high pressure cycle within the rocker arm chamber and open during a low pressure cycle within the rocker arm chamber (FIGS. 1 AND 2); an air outlet 114 disposed on a top of the housing 110; and a vent tube 116 extending between the air outlet 114 and the air discharge port (FIG. 1) and configured to rest within the vent tube recess (FIG. 2), wherein the breather valve assembly 102 is squeezed in position between the bottom surface portion of the rocker arm chamber and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In some embodiments, the housing 110 includes a cylindrical bore 304. In other embodiments, the air outlet 114 is centered on the top of the housing 110. In other embodiments, the vent tube projects through the air outlet 114 within the housing 110 and wherein the oil/air inlet (FIG. 4) is disposed near the top of the housing 110 above a bottom level of the vent tube 116 within the housing 110. In one particular embodiment, the vent tube 116 includes a distention 122 on a first end and wherein the air outlet 114 includes a conical recess with a ring seal (FIG. 7) for accepting the distention 122 on the first end of the vent tube 116. In other embodiments, the vent tube 116 includes a distention 124 on a second end and wherein the air discharge port includes a conical recess with a ring seal 302 for accepting the distention 124 on the second end of the vent tube 116 (FIG. 2). In yet a further embodiment, the vent tube 116 is in a form of a U shape having an elongated portion 208 that rests within an elongated channel of the vent tube recess of the valve cover (FIG. 2). In certain embodiments, the breather valve assembly 102 comprises a movable flap 126.

In one embodiment, a system includes, but is not limited to, a cylinder head including at least: a rocker arm chamber including at least a breather housing mount recess and an air discharge port having a conical recess with a ring seal, the breather housing mount recess being located on a high side of the rocker arm chamber when the cylinder head is used on a V engine; and a valve cover positionable over the rocker arm chamber, the valve cover including at least a vent tube recess (FIGS. 1 AND 2); and a breather valve assembly 102 including at least: a housing 110 having a cylindrical bore 304, the housing 110 including at least: an open bottom 301 configured to seat on the breather housing mount recess such that a bottom surface portion of the rocker arm chamber forms a base of the housing (FIG. 1); an oil outlet (FIG. 4) disposed near a bottom of the housing 110; a flapper valve 126 positioned over the oil outlet (FIG. 4) that is operable to close during a high pressure cycle within the rocker arm chamber and open during a low pressure cycle within the rocker arm chamber; an air outlet 114 centered on a top of the housing 110 and including a conical recess with a ring seal (FIG. 7); a vent tube 116 in a U-shape extending between the air outlet 114 and the air discharge port (FIG. 1) and having an elongated portion 208 configured to rest within the vent tube recess of the valve cover (FIG. 2), the vent tube 116 projecting through the air outlet 114 within the housing 110, the vent tube 116 including a distension 122 on a first end and a distention 124 on a second end for resting in the conical recess of the air outlet 114 and the conical recess of the air discharge port, respectively (FIGS. 1, 2, AND 7); and an oil/air inlet (FIG. 4) disposed near a top of the housing 110 above a bottom level of the vent tube 116 and offset to one side; wherein the housing 110 and the vent tube 116 are secured in position within the rocker arm chamber of the cylinder head without fasteners by being squeezed between the bottom surface portion of the rocker arm chamber and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In one embodiment, a breather valve assembly 102 includes, but is not limited to, a housing 110 including at least: an open bottom 301 configured to seat on a surface portion of a rocker arm chamber of a cylinder head such that the surface portion of the rocker arm chamber forms a base of the housing (FIGS. 1 AND 2); an oil/air inlet (FIG. 4) disposed near a top of the housing 110 offset to one side; an oil outlet (FIG. 4) disposed near a bottom of the housing 110; a valve 126 positioned over the oil outlet (FIG. 4) that is operable to close during a high pressure cycle within the rocker arm chamber and open during a low pressure cycle within the rocker arm chamber; an air outlet 114 disposed on a top of the housing 110; and a vent tube 116 extending between the air outlet 114 and an air discharge port of the rocker arm chamber and configured to rest within a vent tube recess of a valve cover of the cylinder head (FIG. 2), wherein the breather valve assembly 102 is operable to being squeezed in position between the surface portion of the rocker arm chamber and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In some embodiments, the breather valve assembly 102 has a closed bottom that seats or is secured to a surface 120 of the rocker arm chamber 104. In certain embodiments, the cylindrical bore 304 has a larger or smaller diameter and/or is shorter or taller than depicted (e.g., 1-50% larger, smaller, shorter, or taller). In other embodiments, the vent tube 116 projects further or less within the housing 110 (e.g. 1-50% further or less). In further embodiments, the vent tube 116 is longer, shorter, wider, narrower (e.g., projects further or less vertically or extends longer or less horizontally). In some embodiments, the vent tube 116 is a U-shape as depicted or another regular or irregular shape. In certain embodiments, one or more of the ends of the vent tube are flared (single or double) for an AN type plumbing fitting as opposed to having a distention and ring as depicted.

FIG. 4 is a top front-side perspective view of a breather valve assembly, in accordance with an embodiment of the invention. In one embodiment, a system includes, but is not limited to, a cylinder head including at least: a rocker arm chamber including at least a breather housing mount and an air discharge port; and a valve cover positionable over the rocker arm chamber, the valve cover including at least a vent tube recess (FIGS. 1 AND 2); and a breather valve assembly 102 including at least: a housing 110 including at least: an open bottom (FIG. 3) configured to seat on the breather housing mount such that a bottom surface portion of the rocker arm chamber forms a base of the housing 110 (FIGS. 1 AND 2); an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber and open during a low pressure cycle within the rocker arm chamber (FIGS. 1 AND 2); an air outlet 114 disposed on a top of the housing 110; and a vent tube 116 extending between the air outlet 114 and the air discharge port (FIG. 1) and configured to rest within the vent tube recess (FIG. 2), wherein the breather valve assembly 102 is squeezed in position between the bottom surface portion of the rocker arm chamber and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In other embodiments, the air outlet 114 is centered on the top of the housing 110. In other embodiments, the vent tube projects through the air outlet 114 within the housing 110 and wherein the oil/air inlet 112 is disposed near the top of the housing 110 above a bottom level of the vent tube 116 within the housing 110. In one particular embodiment, the vent tube 116 includes a distention 122 on a first end and wherein the air outlet 114 includes a conical recess with a ring seal (FIG. 7) for accepting the distention 122 on the first end of the vent tube 116. In other embodiments, the vent tube 116 includes a distention 124 on a second end and wherein the air discharge port includes a conical recess with a ring seal 302 for accepting the distention 124 on the second end of the vent tube 116 (FIG. 2). In yet a further embodiment, the vent tube 116 is in a form of a U shape having an elongated portion 208 that rests within an elongated channel of the vent tube recess of the valve cover (FIG. 2). In certain embodiments, the breather valve assembly 102 comprises a movable flap 126.

In one embodiment, a system includes, but is not limited to, a cylinder head including at least: a rocker arm chamber including at least a breather housing mount recess and an air discharge port having a conical recess with a ring seal, the breather housing mount recess being located on a high side of the rocker arm chamber when the cylinder head is used on a V engine; and a valve cover positionable over the rocker arm chamber, the valve cover including at least a vent tube recess (FIGS. 1 AND 2); and a breather valve assembly 102 including at least: a housing 110 having a cylindrical bore 304, the housing 110 including at least: an open bottom 301 configured to seat on the breather housing mount recess such that a bottom surface portion of the rocker arm chamber forms a base of the housing (FIG. 1); an oil outlet 118 disposed near a bottom of the housing 110; a flapper valve 126 positioned over the oil outlet 118 that is operable to close during a high pressure cycle within the rocker arm chamber and open during a low pressure cycle within the rocker arm chamber; an air outlet 114 centered on a top of the housing 110 and including a conical recess with a ring seal (FIG. 7); a vent tube 116 in a U-shape extending between the air outlet 114 and the air discharge port (FIG. 1) and having an elongated portion 208 configured to rest within the vent tube recess of the valve cover (FIG. 2), the vent tube 116 projecting through the air outlet within the housing 110, the vent tube 116 including a distension 122 on a first end and a distention 124 on a second end for resting in the conical recess of the air outlet 114 and the conical recess of the air discharge port, respectively (FIGS. 1, 2, AND 7); and an oil/air inlet 112 disposed near a top of the housing 110 above a bottom level of the vent tube 116 and offset to one side; wherein the housing 110 and the vent tube 116 are secured in position within the rocker arm chamber of the cylinder head without fasteners by being squeezed between the bottom surface portion of the rocker arm chamber and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In one embodiment, a breather valve assembly 102 includes, but is not limited to, a housing 110 including at least: an open bottom 301 configured to seat on a surface portion of a rocker arm chamber of a cylinder head such that the surface portion of the rocker arm chamber forms a base of the housing (FIGS. 1 AND 2); an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber and open during a low pressure cycle within the rocker arm chamber; an air outlet 114 disposed on a top of the housing 110; and a vent tube 116 extending between the air outlet 114 and an air discharge port of the rocker arm chamber and configured to rest within a vent tube recess of a valve cover of the cylinder head (FIG. 2), wherein the breather valve assembly 102 is operable to being squeezed in position between the surface portion of the rocker arm chamber and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In some embodiments, the oil/air inlet port 112 is differently sized or shaped, such as smaller, larger, square, rectangular, oval, triangular, or other regular or irregular size or shape. In certain embodiments, the oil/air inlet port 112 is offset to the left as depicted or off to the right. In further embodiments, the oil/air inlet port 112 can be on a different side of the housing 110 and/or can be located further down or further up than depicted. In other embodiments, the flap 126 is differently sized or shaped, such as larger, smaller, rectangular, oval, square, or other regular size or shape. In some embodiments, the flap 126 is replaced with a one-way relief valve. In additional embodiments, the oil outlet port 118 is differently sized or shaped, such as larger, smaller, oval, circular, square, rectangular or other regular or irregular size or shape. The oil outlet port 118 can be further down or higher than depicted and/or located on another side of the housing 110. In some embodiments, the flap 126 is composed of rubber, plastic, or composite material that is flexible to permit opening and closing and that exhibits high temperature durability and resistance. In other embodiments the flap 126 is door that includes hinges for opening and/or closing, which door is composed of a metal, plastic, rubber, or other composite material. Alternatively, the flap 126 may be substituted with a door that slidably opens and/or closes over the oil outlet port 118, which door is composed of a metal, plastic, rubber, or other composite material.

FIG. 5 is a bottom back-side perspective view of a breather valve assembly, in accordance with an embodiment of the invention. In one embodiment, a system includes, but is not limited to, a cylinder head including at least: a rocker arm chamber including at least a breather housing mount and an air discharge port; and a valve cover positionable over the rocker arm chamber, the valve cover including at least a vent tube recess (FIGS. 1 AND 2); and a breather valve assembly 102 including at least: a housing 110 including at least: a spacer plate 502 configured to mount to a bottom surface portion of the rocker arm chamber to form a base of the housing 110, which seats on the spacer plate 502; an oil/air inlet (FIG. 6) disposed near a top of the housing 110 offset to one side; an oil outlet (FIG. 6) disposed near a bottom of the housing 110; a valve (FIG. 6) positioned over the oil outlet (FIG. 6) that is operable to close during a high pressure cycle within the rocker arm chamber and open during a low pressure cycle within the rocker arm chamber (FIGS. 1 AND 2); an air outlet (FIGS. 3 AND 4) disposed on a top of the housing 110; and a vent tube 116 extending between the air outlet (FIGS. 3 AND 4) and the air discharge port (FIG. 1) and configured to rest within the vent tube recess (FIG. 2), wherein the breather valve assembly 102 is squeezed in position between the bottom surface portion of the rocker arm chamber on the spacer plate 502 and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In some embodiments, the vent tube 116 includes a distention 124 on a second end and wherein the air discharge port includes a conical recess with a ring seal 302 for accepting the distention 124 on the second end of the vent tube 116 (FIG. 2). In yet a further embodiment, the vent tube 116 is in a form of a U shape having an elongated portion 208 that rests within an elongated channel of the vent tube recess of the valve cover (FIG. 2).

In one embodiment, a system includes, but is not limited to, a cylinder head including at least: a rocker arm chamber including at least a breather housing mount recess and an air discharge port having a conical recess with a ring seal, the breather housing mount recess being located on a high side of the rocker arm chamber when the cylinder head is used on a V engine; and a valve cover positionable over the rocker arm chamber, the valve cover including at least a vent tube recess (FIGS. 1 AND 2); and a breather valve assembly 102 including at least: a housing 110 having a cylindrical bore (FIG. 6), the housing 110 including at least: a spacer plate 502 configured to mount to a bottom surface portion of the rocker arm chamber to form a base of the housing 110, which seats on the spacer plate 502; an oil outlet (FIG. 6) disposed near a bottom of the housing 110; a flapper valve (FIG. 6) positioned over the oil outlet (FIG. 6) that is operable to close during a high pressure cycle within the rocker arm chamber and open during a low pressure cycle within the rocker arm chamber; an air outlet (FIGS. 3 AND 4) centered on a top of the housing 110 and including a conical recess with a ring seal (FIG. 7); a vent tube 116 in a U-shape extending between the air outlet (FIGS. 3 AND 4) and the air discharge port (FIG. 1) and having an elongated portion 208 configured to rest within the vent tube recess of the valve cover (FIG. 2), the vent tube 116 projecting through the air outlet (FIGS. 3 AND 4) within the housing 110, the vent tube 116 including a distension (FIGS. 3 AND 4) on a first end and a distention 124 on a second end for resting in the conical recess of the air outlet and the conical recess of the air discharge port, respectively (FIGS. 1, 2, AND 7); and an oil/air inlet (FIG. 6) disposed near a top of the housing 110 above a bottom level of the vent tube 116 and offset to one side; wherein the housing 110 and the vent tube 116 are secured in position within the rocker arm chamber of the cylinder head without fasteners by being squeezed between the bottom surface portion of the rocker arm chamber on the spacer plate 502 and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In one embodiment, a breather valve assembly 102 includes, but is not limited to, a housing 110 including at least: a spacer plate 502 configured to mount to a bottom surface portion of the rocker arm chamber to form a base of the housing 110, which seats on the spacer plate 502 (FIGS. 1 AND 2); an oil/air inlet (FIG. 6) disposed near a top of the housing 110 offset to one side; an oil outlet (FIG. 6) disposed near a bottom of the housing 110; a valve (FIG. 6) positioned over the oil outlet (FIG. 6) that is operable to close during a high pressure cycle within the rocker arm chamber and open during a low pressure cycle within the rocker arm chamber; an air outlet (FIGS. 3 AND 4) disposed on a top of the housing 110; and a vent tube 116 extending between the air outlet and an air discharge port of the rocker arm chamber and configured to rest within a vent tube recess of a valve cover of the cylinder head (FIG. 2), wherein the breather valve assembly 102 is operable to being squeezed in position between the surface portion of the rocker arm chamber on the spacer plate 502 and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

Figure 6:
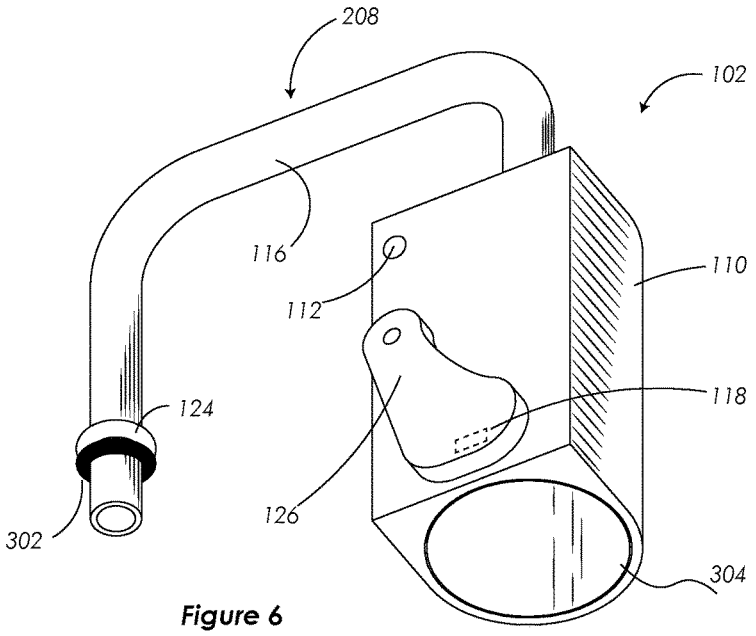
FIG. 6 is a bottom front-side perspective view of a breather valve assembly, in accordance with an embodiment of the invention.

FIG. 6 is a bottom front-side perspective view of a breather valve assembly, in accordance with an embodiment of the invention. In one embodiment, a system includes, but is not limited to, a cylinder head including at least: a rocker arm chamber including at least a breather housing mount and an air discharge port; and a valve cover positionable over the rocker arm chamber, the valve cover including at least a vent tube recess (FIGS. 1 AND 2); and a breather valve assembly 102 including at least: a housing 110 including at least: a spacer plate (FIG. 5) configured to mount to a bottom surface portion of the rocker arm chamber to form a base of the housing 110, which seats on the spacer plate (FIG. 5); an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber and open during a low pressure cycle within the rocker arm chamber (FIGS. 1 AND 2); an air outlet (FIGS. 3 AND 4) disposed on a top of the housing 110; and a vent tube 116 extending between the air outlet (FIGS. 3 AND 4) and the air discharge port (FIG. 1) and configured to rest within the vent tube recess (FIG. 2), wherein the breather valve assembly 102 is squeezed in position between the bottom surface portion of the rocker arm chamber on the spacer plate 502 and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In some embodiments, the vent tube 116 includes a distention 124 on a second end and wherein the air discharge port includes a conical recess with a ring seal 302 for accepting the distention 124 on the second end of the vent tube 116 (FIG. 2). In yet a further embodiment, the vent tube 116 is in a form of a U shape having an elongated portion 208 that rests within an elongated channel of the vent tube recess of the valve cover (FIG. 2).

In one embodiment, a system includes, but is not limited to, a cylinder head including at least: a rocker arm chamber including at least a breather housing mount recess and an air discharge port having a conical recess with a ring seal, the breather housing mount recess being located on a high side of the rocker arm chamber when the cylinder head is used on a V engine; and a valve cover positionable over the rocker arm chamber, the valve cover including at least a vent tube recess (FIGS. 1 AND 2); and a breather valve assembly 102 including at least: a housing 110 having a cylindrical bore 304, the housing 110 including at least: a spacer plate (FIG. 5) configured to mount to a bottom surface portion of the rocker arm chamber to form a base of the housing 110, which seats on the spacer plate (FIG. 5); an oil outlet 118 disposed near a bottom of the housing 110; a flapper valve 126 positioned over the oil outlet 118 that is operable to close during a high pressure cycle within the rocker arm chamber and open during a low pressure cycle within the rocker arm chamber; an air outlet (FIGS. 3 AND 4) centered on a top of the housing 110 and including a conical recess with a ring seal (FIG. 7); a vent tube 116 in a U-shape extending between the air outlet (FIGS. 3 AND 4) and the air discharge port (FIG. 1) and having an elongated portion 208 configured to rest within the vent tube recess of the valve cover (FIG. 2), the vent tube 116 projecting through the air outlet (FIGS. 3 AND 4) within the housing 110, the vent tube 116 including a distension (FIGS. 3 AND 4) on a first end and a distention 124 on a second end for resting in the conical recess of the air outlet and the conical recess of the air discharge port, respectively (FIGS. 1, 2, AND 7); and an oil/air inlet 112 disposed near a top of the housing 110 above a bottom level of the vent tube 116 and offset to one side; wherein the housing 110 and the vent tube 116 are secured in position within the rocker arm chamber of the cylinder head without fasteners by being squeezed between the bottom surface portion of the rocker arm chamber on the spacer plate (FIG. 5) and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In one embodiment, a breather valve assembly 102 includes, but is not limited to, a housing 110 including at least: a spacer plate (FIG. 5) configured to mount to a bottom surface portion of the rocker arm chamber to form a base of the housing 110, which seats on the spacer plate (FIGS. 1 AND 2); an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber and open during a low pressure cycle within the rocker arm chamber; an air outlet (FIGS. 3 AND 4) disposed on a top of the housing 110; and a vent tube 116 extending between the air outlet and an air discharge port of the rocker arm chamber and configured to rest within a vent tube recess of a valve cover of the cylinder head (FIG. 2), wherein the breather valve assembly 102 is operable to being squeezed in position between the surface portion of the rocker arm chamber on the spacer plate (FIG. 1) and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

FIG. 7 is an exploded front-side perspective view of a breather valve assembly, in accordance with an embodiment of the invention. In one embodiment, a system includes, but is not limited to, a cylinder head including at least: a rocker arm chamber including at least a breather housing mount and an air discharge port; and a valve cover positionable over the rocker arm chamber, the valve cover including at least a vent tube recess (FIGS. 1 AND 2); and a breather valve assembly 102 including at least: a housing 110 including at least: a spacer plate 502 configured to mount to a bottom surface portion of the rocker arm chamber to form a base of the housing 110, which seats on the spacer plate 502; an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber and open during a low pressure cycle within the rocker arm chamber (FIGS. 1 AND 2); an air outlet 114 disposed on a top of the housing 110; and a vent tube 116 extending between the air outlet 114 and the air discharge port (FIG. 1) and configured to rest within the vent tube recess (FIG. 2), wherein the breather valve assembly 102 is squeezed in position between the bottom surface portion of the rocker arm chamber on the spacer plate 502 and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In some embodiments, the vent tube 116 includes a distention 122 on a first end and wherein the air outlet 114 includes a conical recess 704 with a ring seal 702 for accepting the distention 122 on the first end of the vent tube 116. In other embodiments, the vent tube 116 includes a distention 124 on a second end and wherein the air discharge port includes a conical recess with a ring seal 302 for accepting the distention 124 on the second end of the vent tube 116 (FIG. 2). In yet a further embodiment, the vent tube 116 is in a form of a U shape having an elongated portion 208 that rests within an elongated channel of the vent tube recess of the valve cover (FIG. 2).

In one embodiment, a system includes, but is not limited to, a cylinder head including at least: a rocker arm chamber including at least a breather housing mount recess and an air discharge port having a conical recess with a ring seal, the breather housing mount recess being located on a high side of the rocker arm chamber when the cylinder head is used on a V engine; and a valve cover positionable over the rocker arm chamber, the valve cover including at least a vent tube recess (FIGS. 1 AND 2); and a breather valve assembly 102 including at least: a housing 110 having a cylindrical bore (FIG. 3), the housing 110 including at least: a spacer plate 502 configured to mount to a bottom surface portion of the rocker arm chamber to form a base of the housing 110, which seats on the spacer plate 502; an oil outlet 118 disposed near a bottom of the housing 110; a flapper valve 126 positioned over the oil outlet 118 that is operable to close during a high pressure cycle within the rocker arm chamber and open during a low pressure cycle within the rocker arm chamber; an air outlet 114 centered on a top of the housing 110 and including a conical recess 704 with a ring seal 702; a vent tube 116 in a U-shape extending between the air outlet 114 and the air discharge port (FIG. 1) and having an elongated portion 208 configured to rest within the vent tube recess of the valve cover (FIG. 2), the vent tube 116 projecting through the air outlet 114 within the housing 110, the vent tube 116 including a distension 122 on a first end and a distention 124 on a second end for resting in the conical recess of the air outlet 114 and the conical recess of the air discharge port, respectively (FIGS. 1 AND 2); and an oil/air inlet 112 disposed near a top of the housing 110 above a bottom level of the vent tube 116 and offset to one side; wherein the housing 110 and the vent tube 116 are secured in position within the rocker arm chamber of the cylinder head without fasteners by being squeezed between the bottom surface portion of the rocker arm chamber on the spacer plate 502 and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In one embodiment, a breather valve assembly 102 includes, but is not limited to, a housing 110 including at least: a spacer plate 502 configured to mount to a bottom surface portion of the rocker arm chamber to form a base of the housing 110, which seats on the spacer plate 502; an oil/air inlet 112 disposed near a top of the housing 110 offset to one side; an oil outlet 118 disposed near a bottom of the housing 110; a valve 126 positioned over the oil outlet 118 that is operable to close during a high pressure cycle within the rocker arm chamber and open during a low pressure cycle within the rocker arm chamber; an air outlet 114 disposed on a top of the housing 110; and a vent tube 116 extending between the air outlet 114 and an air discharge port of the rocker arm chamber and configured to rest within a vent tube recess of a valve cover of the cylinder head (FIG. 2), wherein the breather valve assembly 102 is operable to being squeezed in position between the surface portion of the rocker arm chamber on the spacer plate 502 and the vent tube recess of the valve cover (FIG. 2), and wherein the breather valve assembly 102 is configured to relieve pressure build-up within the cylinder head by externally venting air from an air/oil mixture separated via vortex action induced during high pressure cycles while releasing separated oil back to the cylinder head during low pressure cycles.

In some embodiments, the breather valve assembly 102 is formed from fewer or greater number of components. For instances, the vent tube 116 can part of a unitary structure with the housing 110 and the spacer plate 502. In certain embodiments, the ring seals 302 and 702 are rubber or plastic washers or, alternatively, are substituted with thread or pipe sealant. In some embodiments, the vent tube 116 screws or snaps into the housing 110 and/or the rocker arm chamber 104.

In one embodiment, a method includes, but is not limited to, accepting air/oil via an air/oil inlet of a breather valve assembly positioned within a rocker arm chamber of a cylinder head, separating the air from the oil using vortex action induced via a high pressure state within the rocker arm chamber, releasing the separated air from the cylinder head via a vent port, and releasing the oil back into the rocker arm chamber via an oil outlet port of the breather valve assembly during a low pressure state within the rocker arm chamber.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system comprising:

a cylinder head including at least:

a rocker arm chamber including at least a breather housing mount and an air discharge port; and a valve cover positionable over the rocker arm chamber, the valve cover including at least a vent tube recess; and a breather valve assembly including at least:

a housing including at least:

an open bottom configured to seat on the breather housing mount such that a bottom surface portion of the rocker arm chamber forms a base of the housing;

an oil/air inlet disposed on a side wall of the housing near a top of the housing and offset to one side of the side wall an oil outlet disposed near a bottom of the housing;

a valve positioned over the oil outlet that is operable to close during a high pressure cycle within the rocker arm chamber and open during a low pressure cycle within the rocker arm chamber;

an air outlet disposed on a top of the housing; and a vent tube extending between the air outlet and the air discharge port and configured to rest within the vent tube recess, wherein the breather valve assembly is squeezed in position between the bottom surface portion of the rocker arm chamber and the vent tube recess of the valve cover, and wherein the breather valve assembly is configured to relieve pressure build-up within the cylinder head by externally venting air from an air/oil mixture separated via vortex action induced during high pressure cycles while releasing separated oil back to the cylinder head during low pressure cycles.

2. The system of claim 1, wherein the housing includes a cylindrical bore.

3. The system of claim 1, further comprising:

an oil capture chamber; and a pump to forcibly return oil from the oil capture chamber to an engine oil reservoir.

4. The system of claim 1, wherein the breather housing mount is a recess within a surface of the rocker arm chamber.

5. The system of claim 1, wherein the breather housing mount is a spacer plate secured to a surface of the rocker arm chamber.

6. The system of claim 1, wherein the breather housing mount is located on a high side of the rocker arm chamber when the cylinder head is used on a V engine.

7. The system of claim 1, wherein the air outlet is centered on the top of the housing.

8. The system of claim 1, wherein the vent tube projects through the air outlet within the housing and wherein the oil/air inlet is disposed near the top of the housing above a bottom level of the vent tube within the housing.

9. The system of claim 1, wherein the vent tube includes a distention on a first end and wherein the air outlet includes a conical recess with a ring seal for accepting the distention on the first end of the vent tube.

10. The system of claim 1, wherein the vent tube includes a distention on a second end and wherein the air discharge port includes a conical recess with a ring seal for accepting the distention on the second end of the vent tube.

11. The system of claim 1, wherein the vent tube is in a form of a U shape having an elongated portion that rests within an elongated channel of the vent tube recess of the valve cover.

12. The system of claim 1, wherein the housing and the vent tube are secured in position within the rocker arm chamber of the cylinder head without fasteners by being squeezed between the bottom surface portion of the rocker arm chamber and the vent tube recess of the valve cover.

13. The system of claim 1, wherein the breather valve assembly comprises a movable flap.

14. The system of claim 1, wherein the air discharge port of the rocker arm chamber includes a conical recess with a ring seal.

15. The system of claim 1, wherein the air outlet of the housing includes a conical recess with a ring seal.

16. A system comprising:

a cylinder head including at least:

a rocker arm chamber including at least a breather housing mount recess and an air discharge port having a conical recess with a ring seal, the breather housing mount recess being located on a high side of the rocker arm chamber when the cylinder head is used on a V engine; and a valve cover positionable over the rocker arm chamber, the valve cover including at least a vent tube recess; and a breather valve assembly including at least:

a housing having a cylindrical bore, the housing including at least:

an open bottom configured to seat on the breather housing mount recess such that a bottom surface portion of the rocker arm chamber forms a base of the housing;

an oil outlet disposed near a bottom of the housing;

a flapper valve positioned over the oil outlet that is operable to close during a high pressure cycle within the rocker arm chamber and open during a low pressure cycle within the rocker arm chamber;

an air outlet centered on a top of the housing and including a conical recess with a ring seal;

a vent tube in a U-shape extending between the air outlet and the air discharge port and having an elongated portion configured to rest within the vent tube recess of the valve cover, the vent tube projecting through the air outlet within the housing, the vent tube including a distension on a first end and a distention on a second end for resting in the conical recess of the air outlet and the conical recess of the air discharge port, respectively; and an oil/air inlet disposed on a side wall of the housing above a bottom level of the vent tube and near a top of the housing and offset to one side of the side wall wherein the housing and the vent tube are secured in position within the rocker arm chamber of the cylinder head without fasteners by being squeezed between the bottom surface portion of the rocker arm chamber and the vent tube recess of the valve cover, and wherein the breather valve assembly is configured to relieve pressure build-up within the cylinder head by externally venting air from an air/oil mixture separated via vortex action induced during high pressure cycles while releasing separated oil back to the cylinder head during low pressure cycles.

17. A breather valve assembly comprising:

a housing including at least:

an open bottom configured to seat on a surface portion of a rocker arm chamber of a cylinder head such that the surface portion of the rocker arm chamber forms a base of the housing;

an oil/air inlet disposed on a side wall of the housing near a top of the housing and offset to one side of the side wall an oil outlet disposed near a bottom of the housing;

a valve positioned over the oil outlet that is operable to close during a high pressure cycle within the rocker arm chamber and open during a low pressure cycle within the rocker arm chamber;

an air outlet disposed on a top of the housing; and a vent tube extending between the air outlet and an air discharge port of the rocker arm chamber and configured to rest within a vent tube recess of a valve cover of the cylinder head, wherein the breather valve assembly is operable to being squeezed in position between the surface portion of the rocker arm chamber and the vent tube recess of the valve cover, and wherein the breather valve assembly is configured to relieve pressure build-up within the cylinder head by externally venting air from an air/oil mixture separated via vortex action induced during high pressure cycles while releasing separated oil back to the cylinder head during low pressure cycles.

* * * * *